United States Patent [19]

Proulx

[11] Patent Number: 4,458,448

[45] Date of Patent: Jul. 10, 1984

[54] MOTORIZED PIVOTING GATE WITH VERTICAL LIFTING

[75] Inventor: Roland Proulx, Comté Berthier, Canada

[73] Assignee: Hydro-Quebec, Quebec, Canada

[21] Appl. No.: 379,030

[22] Filed: May 17, 1982

[30] Foreign Application Priority Data

Dec. 17, 1981 [CA] Canada ..... 392534

[51] Int. Cl.[3] ..... E05F 1/04

[52] U.S. Cl. ..... 49/237; 49/254

[58] Field of Search ..... 49/236, 237, 239, 255, 49/254, 238

[56] References Cited

U.S. PATENT DOCUMENTS

| | | | |
|---|---|---|---|
| 924,430 | 6/1909 | Cook | 49/238 |
| 2,925,674 | 2/1960 | Madden | 49/237 X |
| 3,520,642 | 8/1950 | Laurantus | 49/238 |

FOREIGN PATENT DOCUMENTS

| | | | |
|---|---|---|---|
| 393963 | 6/1933 | United Kingdom | 49/237 |

*Primary Examiner*—Philip C. Kannan

*Attorney, Agent, or Firm*—Oblon, Fisher, Spivak, McClelland & Maier

[57] ABSTRACT

The disclosure describes a device enabling a gate to pivot while making a vertical lifting. The device comprises a vertical member, such as a metallic post, helicoidal guides on the vertical member, displacing means fixed on the gate and associated with the helicoidal guides as well as means enabling a vertical lifting of the gate when the displacing means follow a path which is determined by the helicoidal guides, which enable the gate to pivot and to open while making said vertical lifting. This gate has as a main advantage to overcome the difficulties resulting from snow falls, and finds its main utility in the electrical substations and buildings which must often be reached in spite of adverse weather conditions.

22 Claims, 16 Drawing Figures

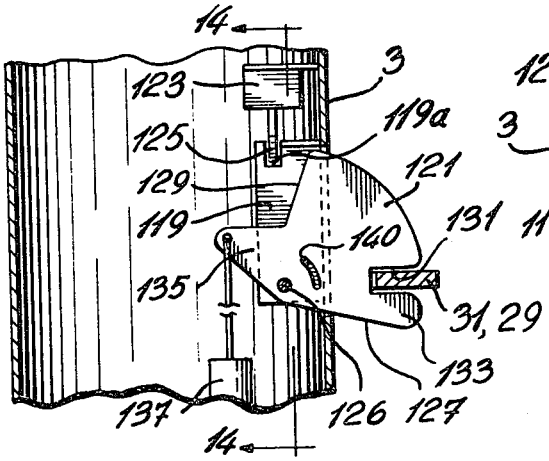
Fig. 13
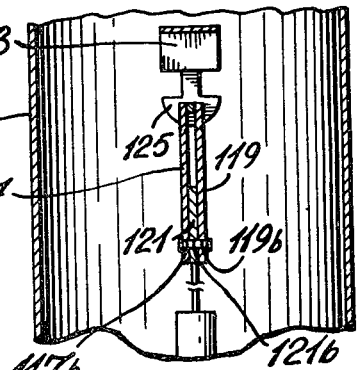
Fig. 14
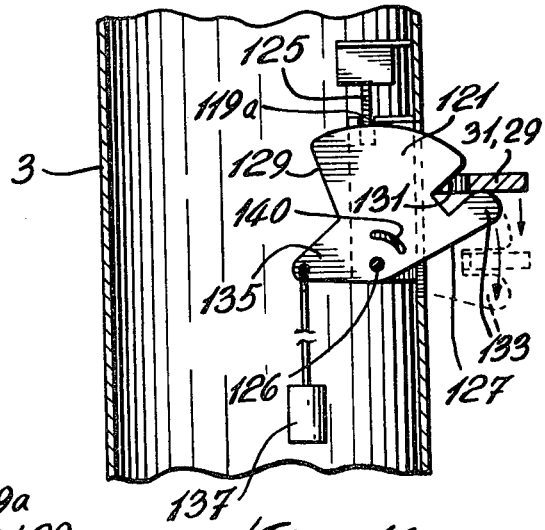
Fig. 15
Fig. 16
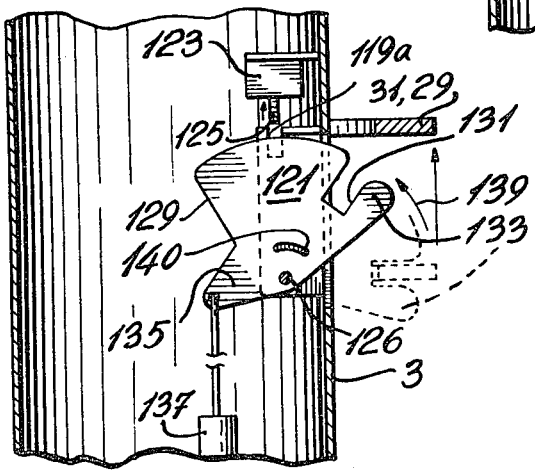

MOTORIZED PIVOTING GATE WITH VERTICAL LIFTING

BACKGROUND OF THE INVENTION (a) Field of the Invention

The invention concerns a motorized gate. More specifically, the invention is directed to a device enabling a gate to pivot while effecting a vertical lifting.

(b) Description of the Prior Art

It is known that many commercial and industrial buildings as well as some outlets, such as electrical substations, should be fenced in order to protect them against theft and/or vandalism and in certain cases, because they present a real danger even for the onlookers, such as children. Now, the persons in charge of the maintenance of these sites are often urgently called in to make repairs or to carry out operations which cannot be postponed. In such cases, it is nearly always necessary to penetrate inside the fenced in area with some equipment which implies that trucks or pick-ups and often other types of motorized vehicles must be brought inside the enclosure. If there was a sudden accumulation of an important quantity of snow, it is often impossible to open the gate without previously having removed that which prevents the opening of the gate. It will be understood that in urgent cases, it is not always possible to proceed to snow removal in the sector represented by the opening of the gate, without risking serious consequences. There is therefore a marked interest in having a gate conceived in such a manner as to enable a more or less important vertical elevation and which does not require a large frame.

In order to overcome the difficulties mentioned, I have invented a device enabling a gate to pivot while effecting a vertical lifting. The device comprises a vertical member, helicoidal guides on the vertical member, displacing means fixed on said gate, and means associated with the helicoidal guides enabling a vertical lifting of the gate while the displacing means follow a path determined by the helicoidal guides, which enable the gate to pivot and to open while effecting said vertical lifting.

According to a preferred embodiment of the invention, the helicoidal guides are made of metallic bars which are mounted on the vertical member.

According to another preferred embodiment of the invention, the vertical member is constituted by a metallic post. Preferably, the metallic bars are welded on the surface of the post.

According to another preferred embodiment of the invention, the metallic bars have a square cross-section.

The device preferably comprises two lower metallic bars opposed to one another and located at a same lower level, as well as two upper metallic bars, which are opposed to one another and located at a same upper level.

Each metallic bar preferably comprises a lower rectilinear portion which only permits a vertical lifting of the gate, followed by a helicoidal portion which enables a simultaneous vertical lifting of the gate and a pivoting of the latter, followed by an upper rectilinear vertical portion to complete the lifting of the gate.

Preferably, the displacing means are rolling means, for example, carriages.

According to another preferred embodiment of the invention, the device comprises a lower semi-annular element shaped to surround the post and an upper semi-annular element shaped to surround the post, a carriage being fixed at the two ends of each semi-annular element so that each carriage engages the corresponding metallic bar.

The semi-annular elements preferably comprise means intended to mount the gate.

According to another preferred embodiment of the invention, the two semi-annular elements are connected together by means of a rod to constitute a rigid assembly, the rod having a length such that, when there is a vertical displacement of the gate, the lower semi-annular element is at a level of the lower metallic bars which corresponds to the level of the upper metallic bars opposite which the upper semi-annular element is placed.

Even though any means known to those skilled in the art can be used to connect the gate to the device, it is preferable to have gate supports fixed on the semiannular elements so as to receive the gate.

According to a preferred embodiment of the invention, each carriage comprises an L-shaped element and two parallel blocks fixedly mounted rearwardly and at the ends of one of the legs of the L-shaped element, a longitudinal notch being formed in each block, an axle mounted between the two blocks, the ends thereof being capable of sliding within the notches, a bobbin-shaped roll mounted to roll freely over said axle, a bore provided in each of said blocks, the bore comprising a threaded portion, a coil spring disposed in said bore and resting against the axle by means of a gudgeon and a tightening screw mounted in the threaded portion of the bore and resting against the coil spring, two freely rotatable rollers mounted on the other leg of the L-shaped element so as to engage both sides of one of the metallic bars while the bobbin-shaped roller rests against the upper face of the corresponding metallic bar under the action of the coil spring, and a connecting member enabling the mounting of the carriage on the semi-annular element.

The connecting member preferably comprises a rod having one end welded on the other leg of the L-shaped element, a pipe surrounding the rod so as to rotate around said rod, the pipe being on the other hand welded at the end of the semi-annular element, thus enabling the carriage to pivot while following the path of the metallic bar.

The means enabling a vertical lifting of the gate preferably comprise a pulley and a cable mounted on the gate and winding around the pulley as well as a motor to move the cable and thereby lift the gate.

BRIEF DESCRIPTION OF THE DRAWINGS

The invention will now be illustrated merely by way of example and without restricting the scope of the invention by means of the annexed drawings in which:

FIG. 13 is a front view of the locking mechanism;

FIG. 14 is a cross-section taken along line 14—14 of FIG. 13;

FIG. 15 shows the locking mechanism being unlocked;

FIG. 16 shows the locking mechanism being locked.

DESCRIPTION OF PREFERRED EMBODIMENTS

Figure 1:
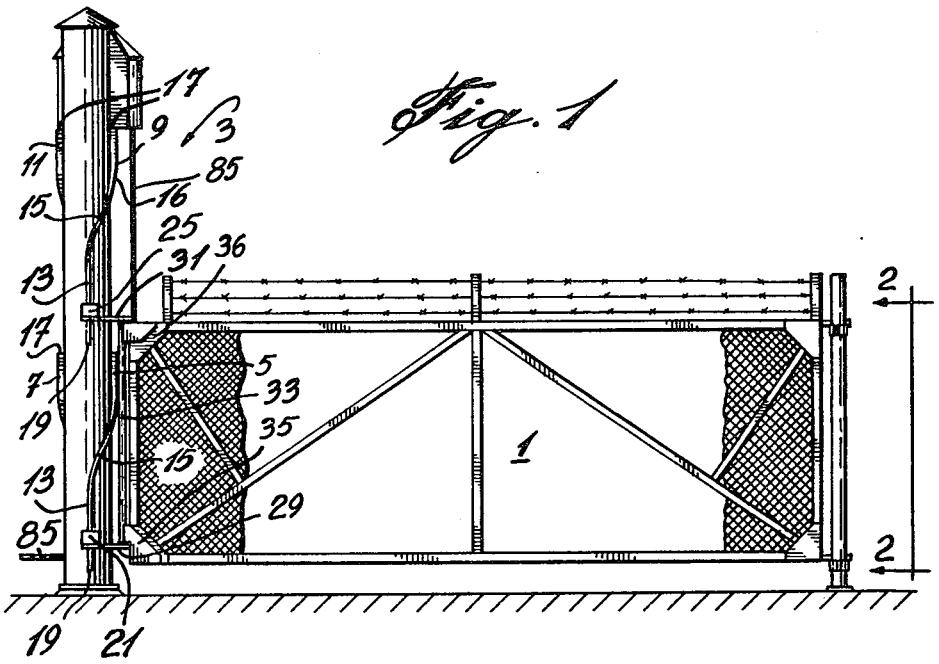
FIG. 1 is a front view of the device according to the invention, including the gate.
Figure 2:
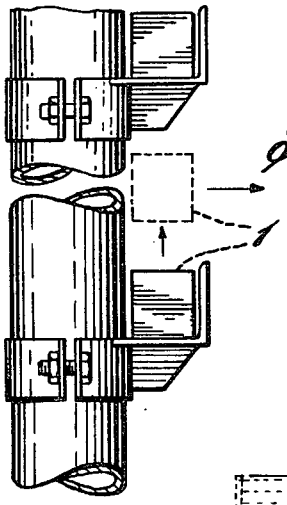
FIG. 2 is a view taken along line 2—2 of FIG. 1.
Figure 3:
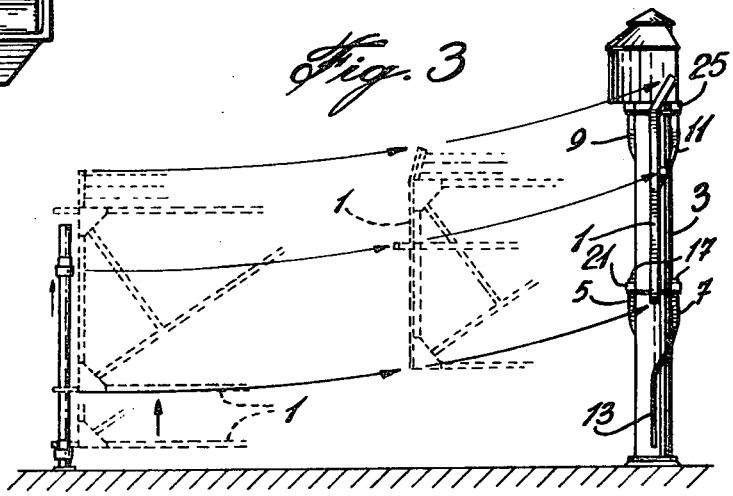
FIG. 3 is a view taken from inside the enclosure showing the gate in raised position and completely opened.

With respect to the drawings, it will be seen that the idea is to enable a gate 1 to pivot as usual and at the same time, to enable it to rise or effect a vertical lifting which makes it possible to open in spite of obstacles, such as snow, which could be found on the path of the gate 1, when it is opened without lifting it.

The device which enables this pivoting and lifting action is centered around a metallic post 3 whose diameter is sufficient to mount the arrangement which will now be described.

As will be seen in the drawings, there are two lower metallic bars 5 and 7, which are longitudinally welded on the surface of the post 3. It will also be noted that the two metallic bars 5 and 7 have square cross-section, that they are opposite one another and that they are at the same lower level on the post 3.

On the other hand, there are two upper metallic bars 9 and 11, which are also longitudinally welded on the surface of the post 3. These upper metallic bars are identical to the lower metallic bars, i.e., they have the same shape, as will be seen later, and they also have square cross-section.

As seen in the drawings, the metallic bars 9 and 11, are at a same upper level on the post 3 and are also opposite to one another.

It was mentioned above that the four metallic bars 5, 7, 9 and 11 are identical. As illustrated, each comprises a lower rectilinear portion 13, which, as will be seen later, only enables a vertical lifting of the gate for a certain distance. This rectilinear portion 13, is followed by a helicoidal portion 15, which, as will be seen later, permits at the same time a new vertical lifting of the gate as well as a pivoting of the latter, all as shown in the drawings. This is followed by another vertical rectilinear portion 16 to complete the lifting of the gate. On the other hand, it will be noted that the helicoidal portion 15 somewhat wraps itself on the surface of the post while climbing on the latter until the upper end 17 of the metallic bar has rotated 90° with respect to the lower rectilinear portion 13. The bars 5, 7, 9, 11 have lower ends 19.

Referring again to the drawings, it will be realized that each helicoidal guide or metallic bar 5, 7, 9 and 11 is used to engage a carriage which, in final analysis, will be responsible for the lifting and the pivoting of the gate 1. So, there will be one carriage for each metallic bar. Therefore, there are four carriages 21, 23, 25 and 27 which respectively engage the metallic bars 5, 7, 9 and 11. On the other hand, in order that these carriages 21, 23, 25 and 27 be able to operate the gate 1 as was mentioned above, they should be connected to the latter. For this purpose, the arrangement which will now be described will be used.

This arrangement comprises two semi-annular elements 29 and 31. It will first of all be noted that the carriages 21 and 23 are fixed on the semi-annular element 29 and that the carriages 25 and 27 are fixed on the semi-annular element 31. These two elements 29 and 31 as well as the exact manner whereby the carriages 21, 23, 25 and 27 are mounted thereon will be described in detail later.

For the time being, it must be pointed out that this arrangement is made of two semi-annular elements 29 and 31 which are connected together by means of a rod 33, as can be seen on the drawings, to form a rigid assembly. This rod 33 is preferably of circular cross-section and its length is such that, during a vertical displacement of the rigid assembly, the lower element 29 is at a level of the metallic bars 5 and 7 which corresponds to the level of the metallic bars 9 and 11 adjacent to which the upper semi-annular element 31 is located.

The rigid assembly made of the semi-annular elements 29 and 31 as well as the rod 33 comprises the gate supports 35 and 36 on which the gate 1 is mounted.

Each semi-annular element 29 and 31 is identical and has a horse-shoe shape, more specifically as illustrated in the drawings. These semi-annular elements should both be shaped to surround the post 3 in part in order to always be proximate the latter during a vertical displacement of the assembly, as will be seen later.

Before describing the manner of fixing the carriages 21, 23, 25 and 27 on the semi-annular elements 29 and 31, the exact structure of the carriages should be described. Because these carriages are identical, it will be sufficient to give one description which will be applicable to all the carriages. However, before doing so, it should be mentioned that a carriage is mounted at both ends of each semi-annular element so that each carriage engages a corresponding metallic bar. That is the carriage 21 is engaged on the metallic bar 5, the carriage 23 is engaged on the metallic bar 7, the carriage 25 is engaged on the metallic bar 9 and the carriage 27 is engaged on the metallic bar 11.

Figure 4:
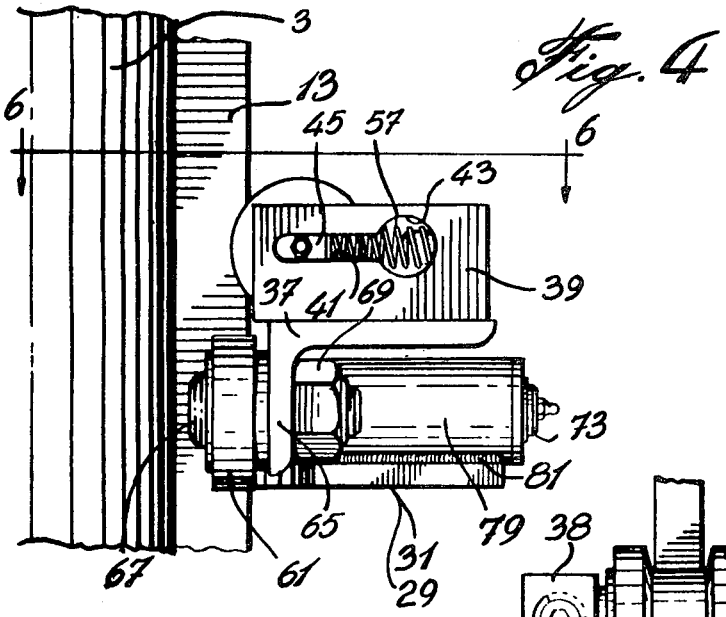
FIG. 4 is a side view of a carriage and its support.
Figure 5:
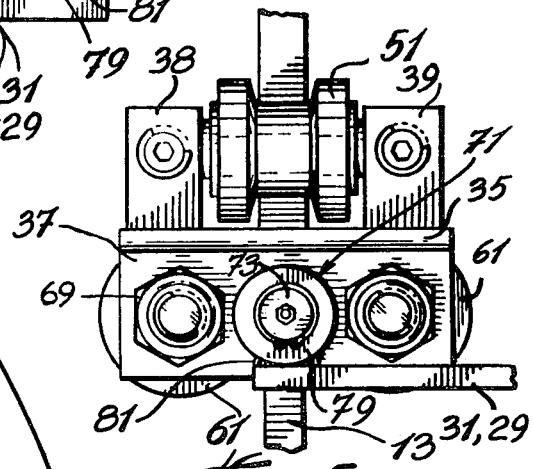
FIG. 5 is a view in elevation of the carriage and its support.
Figure 6:
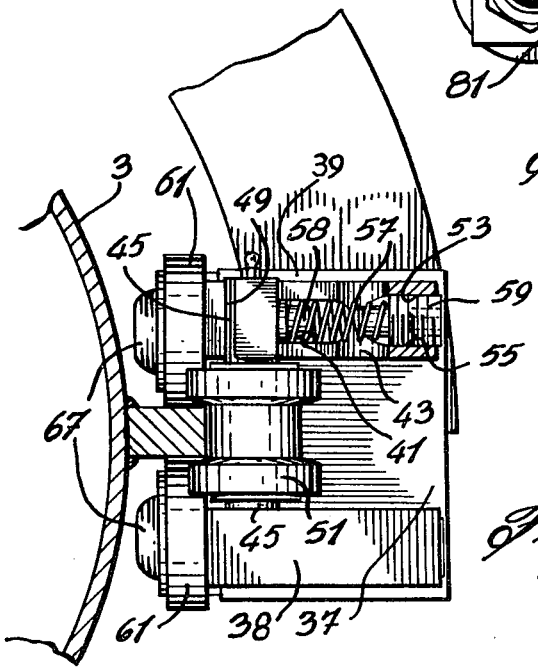
FIG. 6 is a cross-section taken along line 6—6 of FIG. 4.

With reference to the FIGS. 4–6, it will be seen that each carriage comprises an L-shaped element 37 and two parallel blocks 38 and 39 which are fixedly mounted, such as by welding, at both ends of the horizontal legs of the L-shaped element 37, all as illustrated in the drawings. Both blocks 38 and 39 comprise a longitudinal notch 41 as well as an enlargement 43 of the latter in the form of a circle, so as to give the appearance of a keyhole. An axle 45 is retained between the two blocks 38 and 39 by means of borings 49 provided for this purpose. With reference to the drawings, it will be seen that the ends of axle 45 can slide in the notches 41 provided in the two blocks 38 and 39. It should be mentioned at this time that the enlargement 43 provided in the blocks 38 and 39 serves to insert the axle 45 between the two blocks. The carriage also comprises a bobbin-shaped roller 51 which is mounted to be freely rotatable on the axle 45, all as shown in the drawings. Each block 38, 39 comprises a second bore 53 in axial direction, which comprises a threaded portion 55. A coil spring 57 is disposed in the longitudinal notch 41 so as to rest against the axle 45 by means of a gudgeon 58. The coil spring 57 is maintained by means of a tightening screw 59, which rests against the coil spring 57 as shown in the drawings. Finally, the carriage comprises two freely rotatable rollers 61 which are mounted on the vertical leg 65 of the L-shaped element 37, by means of a bolt 67 and locking nut 69, so as to engage both sides of one of the metallic bars 5, 7, 9 and 11 such as illustrated in the drawings. In this position of the free rotatable rollers 61, the bobbin-shaped roller rests on the upper face of the corresponding metallic bar under the action of the coil spring 57.

Obviously, each carriage 21, 23, 25 and 27 should be fixed to a semi-annular element 29 or 31. For this purpose, there are provided connecting members 71 which are obviously four in number and are all identical. It will therefore be sufficient to describe one only.

The connecting member 71 comprises a rod 73 in which one end is welded on the vertical leg 65 of the L-shaped element 37. A pipe 79 surrounds the rod 73 around which it can rotate. On the other hand, the pipe 79 is welded at the end of the corresponding semi-annular element 29 and 31, at 81, which enables the cairiage to pivot by following the path of the metallic bar on which it is engaged.

Figure 7:
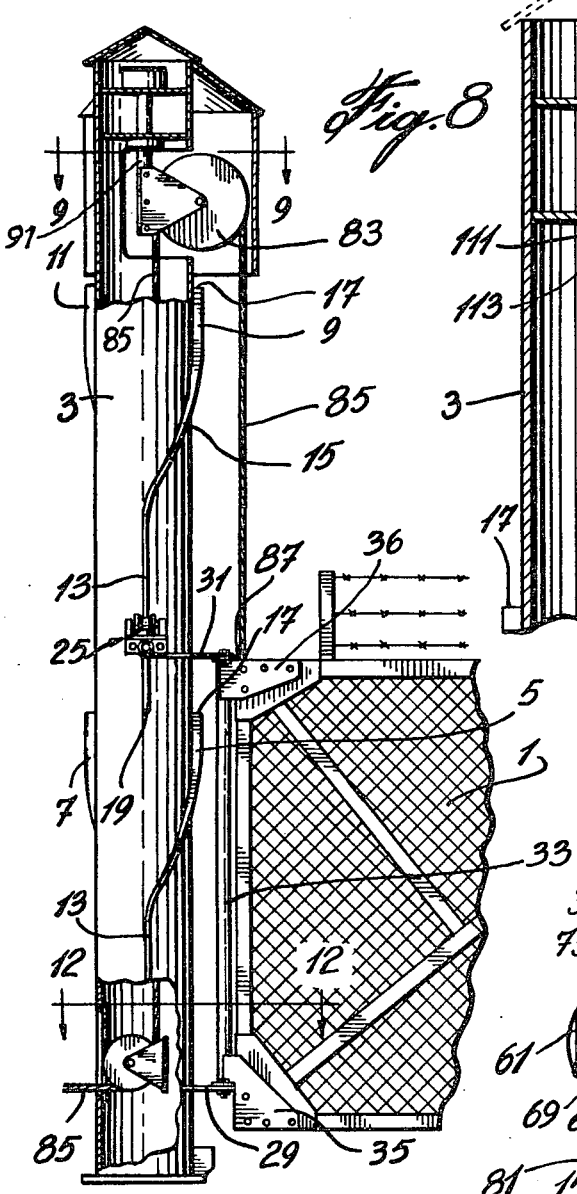
FIG. 7 is a view of the device including a portion of the gate showing the lifting mechanism.
Figure 8:
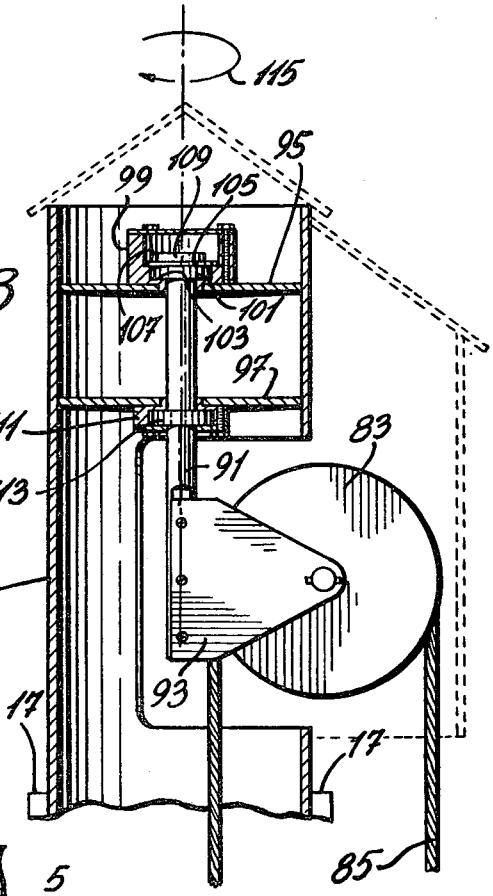
FIG. 8 is a view of the pulley.
Figure 11:
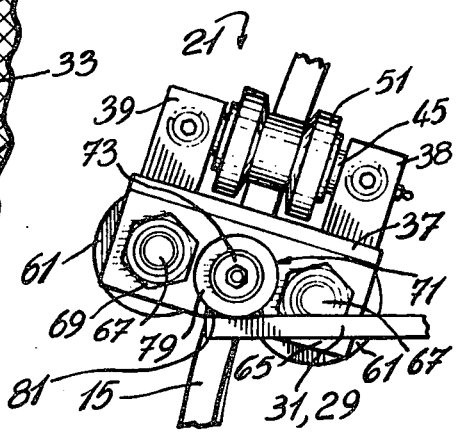
FIG. 11 is an enlarged view showing the pivoting of a carriage with respect to the semi-annular element.
Figure 9:
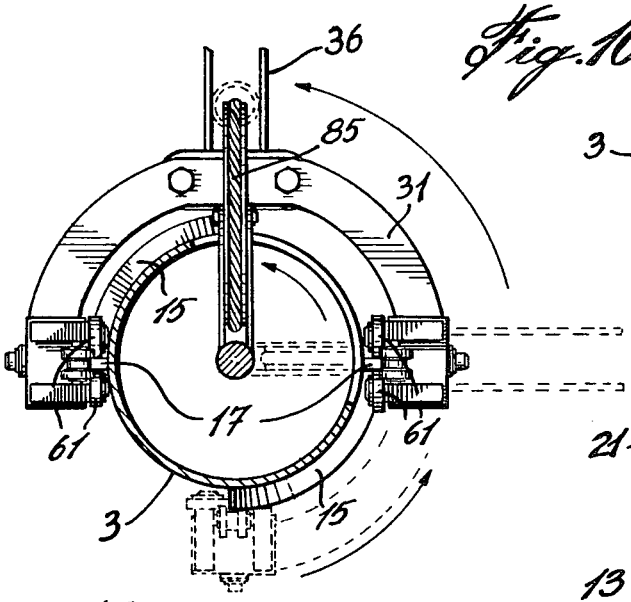
FIG. 9 is a cross-section taken along line 9—9 of FIG. 7.
Figure 10:
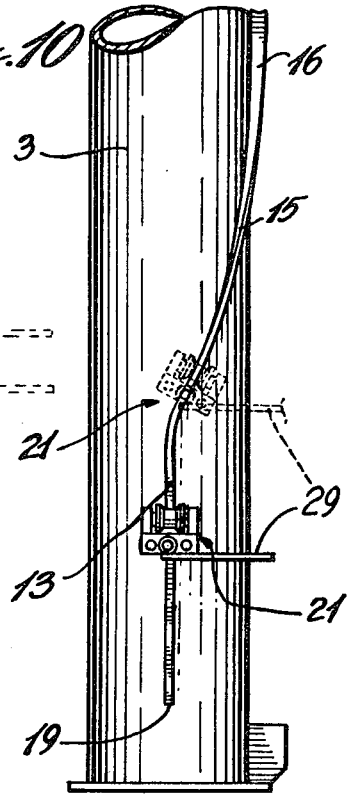
FIG. 10 shows the displacement of a carriage on the metallic post.
Figure 12:
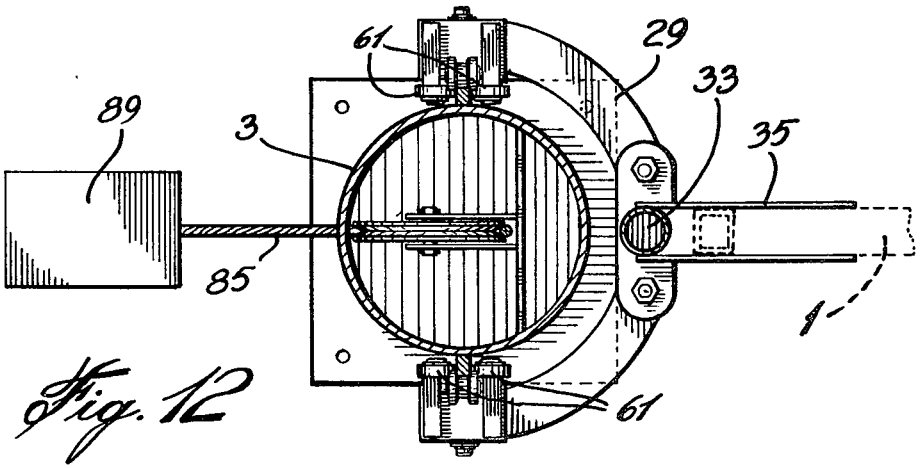
FIG. 12 is a cross-sectional view taken along line 12—12 of FIG. 7.

Finally, the device as illustrated in FIGS. 7–9 comprises a pulley 83 around which cable 85 is allowed to wind. The end of this cable is fixed or mounted in known manner at 87 on the gate 1. With respect to the cable 85, it is moved around the winch 83 by means of a motor 89 (shown in FIG. 12).

Referring more specifically to FIGS. 7 and 8, which illustrate the mounting of the pulley 83 on the post 3 as well as its operation, it will be seen that the pulley 83 is connected to a pivot axle 91 by means of a pulley support 93. The pivot axle 91 is mounted inside post 3 at the upper part thereof, as seen in the drawings. For this purpose, there are provided two parallel horizontal disks 95 and 97 which are mounted in known manner inside the post 3. These two disks 95 and 97 are provided with aligned holes enabling pivot axle 91 to pass therethrough in a position which is strictly vertical. A ball bearing seat 99 is disposed on the disk 95. The latter receives the ball bearing 101 in a seat 103 while thrust bearing 105 disposed as shown in FIG. 8, on the shoulder 107, holds the pivot axle 91 by means of the retaining head 109 provided at the upper part of the pivot axle 19. Under the disk 97, there is a ball bearing seat 111 which receives the ball bearing 113.

It will be seen that by the action of the motor 89, pulley 83 and cable 85, there is a pivoting of the gate. In order to prevent the cable 85 from being cumbersome during the ascending and descending motion of the gate, there is provided the pivoting mechanism described above, which enables the pivoting of the pulley 83. Indeed, when the gate pivots, the pulley has a tendency to undergo a corresponding movement. The pivot axle 91 which is mounted to pivot freely in the ball bearings 101 and 113 enables the pivoting of the pulley, in the direction of the arrow 115 (shown in FIG. 8).

The gate 1 is normally integrated to the peripheral fence of an electrical substation or of an industrial plant to be protected and serves to control the movements in and out of the electrical substations or the industrial plant.

In the case of an electrical substation, the operator of the substation is in a control building (not illustrated) located about 45 meters away from the gate 1, inside the substation and he is responsible for normally operating the gate 1. In normal operation, the motor 89 is adjusted so that the gate 1 takes about 10 seconds to be fully opened or closed.

The operation of the gate is possible either by communicating with the operator, or by using a key. The gate opens after the operator has pushed on a button "open" (not illustrated) or when the visitor uses his key (not illustrated). The communication can, for example, take place by means of a telephone (not illustrated) placed on the left side of the driver of a vehicle which it is desired to bring through the gate. A local code is also possible instead of a key.

As soon as the operator pushes on the button "open" or uses his key or a code, the motor 89 is started and the gate opens by lifting and pivoting under the action of the pulley 83 and the cable 85. When the gate is completely opened, the motor stops automatically. To close the gate, the operator pushes on the button "close" (not illustrated) or uses his key or the code, and the motor operates in a reverse manner to close the gate.

Finally, as a security, there is provided a lock for the gate according to the invention.

As shown in FIGS. 13–16, this lock essentially comprises two vertical plates 117 and 119, which are spaced and parallel to one another. Between these two plates, there is a cam 121, and above this assembly, there is a solenoid 123 provided with a plunger 125.

More specifically, the two plates 117 and 119 are rectangular and are both provided with notches **117*a* and 119*a* at their upper part thereof. In the drawings, these notches are rectangular, even though any shape could be selected as long as they enable the locking of the gate. These two plates 117 and 119 are mounted in known manner on the post 3 in an opening provided for this purpose. It will be noted that each plate 117, 119 as well as the cam 121 are provided with aligned holes 117*b*, 119*b* and 121*b* at the lower part thereof as will be seen in the drawings. A bolt 126 extends through the three holes 117*b*, 119*b* and 121*b*, to join the two plates 117 and 119 as well as the cam 121. This bolt 126 should be such that cam 121 can pivot about the bolt 126 while the two plates 117, 119** remain fixed.

Before proceeding further with this description, the shape of the cam 121 should now be described. As seen in the drawings, the latter has the general shape of a 90° sector the two radii of the sector being represented by the reference numerals 127 and 129. The cam is furthermore provided with a notch 131 to form a tongue 133. This tongue 133 is adjacent to the radius 127. With respect to radius 129, the latter comprises a triangular extension 135 which serves to hook a counterweight 137. Finally, to complete this device, there is provided the previously mentioned solenoid 123 provided with a plunger 125 which should be capable of being inserted in the notches **117*a*, 119*a***.

In locking position, the lock is such as shown in FIG. 13, the semi-annular element 31 being inserted in the notch 131 of the cam 121, and the plunger 125 resting in the notches **117*a* and 119*a* thereby preventing the pivoting of the cam 121 which would abut the plunger 125 by its radius 129. It is therefore the plunger 125 and the cam 121 which are responsible for the locking of the gate. When it is desired to open the gate, it should first of all be unlocked. For this purpose, the solenoid 123 is operated which causes a retraction of the plunger 125. In raised position of the plunger 125, the cam 121 can now pivot in the direction indicated by the arrow 139 (shown in FIG. 15). The lifting movement of the gate 1 can therefore be pursued. At the start of the ascending movement, after initiating the solenoid 123, the vertical movement of the semi-annular element 31 causes a pivoting of the cam 121 in the direction indicated by the arrow 139 until it has completely come out of the notch 131. In this position, the cam is normally unstable but by the action of the counterweight 137, the pivoting of the cam is continued until it is stable, where it is stopped by a stopper 140 in a position in which the semi-annular element 31 can again contact the tongue 133** during its downward movement.

For closing the gate, the semi-annular element 31 is again inserted in the notch 131, in its descending movement. This forces the pivoting of the cam 121 in the opposite direction while the plunger 125 again penetrates in the notches 117*a*, 119*a*, which locks the gate.

Obviously, the controls required for the operation of the gate do not fall within the scope of the invention and the choice is left to the men of the art.

I claim:

1. A device enabling a gate to effect a vertical lifting while pivoting, which comprises, a vertical member, helicoidal guides extending first vertically and then helicoidally on said vertical member, displacing means mounted on said gate, said displacing means being associated with said helicoidal guides so as to be movable along said helicoidal guides, and means on said vertical member enabling a vertical lifting of the gate while the displacing means follows a path determined by the helicoidal guides, which enable the gate to pivot and to open while effecting said vertical lifting.

2. A device according to claim 1 wherein said helicoidal guides are made of metallic bars which are fixed on said vertical member.

3. A device according to claim 2, wherein the metallic bars have square cross-section.

4. A device according to claim 2, wherein the vertical member comprises a metallic post.

5. A device according to claim 4, wherein the metallic bars are welded on the surface of the post.

6. A device according to claim 4, which comprises two lower metallic bars opposite one another and located at a same lower level and two upper metallic bars opposite one another and located at a same upper level.

7. A device according to claim 6, wherein each metallic bar comprises a lower rectilinear portion which only enables a vertical lifting of the gate, followed by a helicoidal portion which enables a simultaneous vertical lifting of the gate and pivoting of the latter, and followed by an upper rectilinear vertical portion to complete the lifting of the gate.

8. A device according to claim 7, wherein the displacing means comprises rolling means.

9. A device according to claim 8, wherein the rolling means comprises carriages.

10. A device according to claim 9, which comprises a lower semi-annular element shaped to surround the post, and an upper semi-annular element, shaped to surround the post, a carriage fixed at both ends of each semi-annular element so that each carriage engages a correspohding metallic bar.

11. A device according to claim 10, wherein the semi-annular elements comprise means adapted to mount the gate.

12. A device according to claim 11, wherein the two semi-annular elements are connected together by means of a rod to define a rigid assembly, said rod having a length such that when there is a vertical displacement of said gate, the lower semi-annular element is at a level of said lower metallic bars which correspond to the level of the upper metallic bars opposite which the upper semi-annular element is located.

13. A device according to claim 12, which comprises gate supports mounted on said semi-annular elements to receive said gate.

14. A device according to claim 12, wherein each carriage comprises an L-shaped element and two parallel blocks mounted rearwardly and at the ends of one of the legs of the L-shaped element, a longitudinal notch provided in each block, an axle disposed between the two blocks and whose ends are adapted to slide in said notches, a bobbin-shaped roller mounted to be freely rotatable on said axle, a bore provided in each of said blocks, said bore comprising a threaded portion, a coil spring disposed in said bore and resting on said axle by means of a gudgeon and a tightening screw in said threaded portion of said bore, said screw resting on said coil spring, two freely rotatable rollers on the other leg of said L-shaped element so as to engage both sides of one of said metallic bars while the bobbin shaped roller rests on the upper face of the corresponding metallic bar under the action of said coil spring, and a connecting member enabling it to connect the carriage of said semi-annular element.

15. A device according to claim 14, wherein the connecting member comprises a rod having one end welded on the other leg of the L-shaped element, a pipe surrounding said rod around which it is adapted to rotate, said pipe being welded at the end of the semi-annular element, which enables the carriage to pivot while following the path of the metallic bar.

16. A device according to claim 3, where the means enabling a vertical lifting of the gate comprises a rotatable pulley and a cable pivotally mounted at the top of said post and attached to said gate and winding around said pulley as well as a motor to wind the cable around the pulley and thereby lift the gate.

17. A device according to claim 16 which comprises a vertical pivot axle mounted on said post to be freely rotatable, said pulley being mounted on said pivot axle in order to pivot when the gate pivots when it rises or descends.

18. A device enabling a gate to effect a vertical lifting while pivoting which comprises:

a metallic post;

two lower square cross-section metallic bars, longitudinally welded on the surface of the post, the two lower metallic bars being opposite to one another and located at a same lower level;

two upper square cross-section metallic bars longitudinally welded on the surface of the post, the two upper metallic bars being opposite one another and located at a same upper level;

each of said lower and upper metallic bars comprising a lower rectilinear portion which only permits a vertical lifting of the gate, followed by a helicoidal portion which enables a simultaneous vertical elevation of the gate and a pivoting of the latter; and finally a vertical rectilinear portion to complete the lifting of the gate;

a lower semi-annular element shaped to surround the post, and an upper semi-annular element also shaped to surround the post;

the two semi-annular elements being connected together by means of a rod to define a rigid assembly;

said rod having a length such that during a vertical displacement of said gate, the lower semi-annular element is located at a level of said lower metallic bars which corresponds to a level of said upper metallic bars, opposite which the upper semi-annular element is mounted;

gate supports mounted on said semi-annular elements to receive said gate;

a carriage fixed at the two ends of each semi-annular element so that each carriage engages a corresponding metallic bar;

each carriage comprising an L-shaped element and two parallel blocks, mounted rearwardly and at the ends of one of the legs of the L-shaped element, a longitudinal notch provided in each of said blocks, an axle disposed between the two blocks, the ends of said axle adapted to slide in said notches, a bobbin shaped roller mounted to freely rotate on said axle, a bore provided in each of said blocks, said bore comprising a threaded portion, a coil spring disposed on said bore and resting against said axle by means of a gudgeon and a tightening screw in said threaded portion of said bore and resting against the coil spring, two freely rotatable rollers on the other leg of said L-shaped element so as to engage both sides of one metallic bar while the bobbin-shaped roller rests on the upper face of the corresponding metallic bar under the action of said coil spring, and a connecting member enabling it to connect the carriage to the semi-annular element;

said connecting member comprising a rod having one end welded on the other leg of said L-shaped element, a pipe connecting said rod around which it is adapted to rotate, said pipe being welded at the end of the semi-annular element, which enables the carriage to pivot while following the path of the metallic bars;

a pulley and a cable fixed on the gate and winding around said pulley;

a vertical pivot axle mounted on said post to be freely rotatable said pulley being mounted on said pivot axle in order to pivot when the gate pivots when it rises or descends.

19. A device according to claim 18, which comprises means for locking said gate.

20. A device according to claim 19, wherein said locking device is a caming device.

21. A device according to claim 20, wherein said caming device comprises two spaced plates which are parallel to one another, and are mounted on said post, and a cam disposed to pivot between the two plates, said cam comprising a catch defining a tongue, the upper semi-annular element being inside said catch when the gate is closed, the two plates being provided with notches, a solenoid with plunger placed above the two plates, the plunger being normally disposed in the notches, but when the solenoid is operated, the plunger retracts and exits from the notches, so that to open the gate and unlock the same, the solenoid is started and the gate is raised which causes the semi-annular element to move upwardly and produces a pivoting of the cam, and to close the gate and lock the same, the latter is moved downward which forces the semi-annular element to abut the tongue of the cam and causes the pivoting of the latter in opposite direction until the plunger is again inserted in the notches of the plates and locks the gate.

22. A device enabling a gate to effect a vertical lifting while pivoting, said device comprising:

(a) a vertical member;

(b) a guide mounted on said vertical member, said guide comprising a lower vertical portion which only enables a vertical lifting of the gate, followed by a helicoidal portion which enables a simultaneous vertical lifting and horizontal pivoting of the gate, followed by an upper vertical portion which only enables a vertical lifting of the gate;

(c) displacing means mounted on said gate, said displacing means being associated with said guide so as to be movable therealong; and (d) means on said vertical member for lifting and pivoting said gate in a path determined by the cooperation of said guide and said displacing means, whereby the gate effects a vertical lifting while pivoting open.

* * * * *